US006135428A

United States Patent [19]

Schliemann et al.

[11] Patent Number: 6,135,428

[45] Date of Patent: Oct. 24, 2000

[54] DIAPHRAGM CARBURETOR FOR AN INTERNAL COMBUSTION ENGINE WITH A MANUAL STARTER

[75] Inventors: Harald Schliemann, Waiblingen; Hans Nickel, Cottenweiler, both of Germany

[73] Assignee: Andreas Stihl AG & Co., Germany

[21] Appl. No.: 09/141,639

[22] Filed: Aug. 27, 1998

[30] Foreign Application Priority Data

Aug. 29, 1997 [DE] Germany ..... 197 37 763

[51] Int. Cl.[7] ..... F02M 7/12

[52] U.S. Cl. ..... 261/35; 261/63

[58] Field of Search ..... 261/35, 63, 69.1, 261/57, 48, 39.1, 39.3, 39.5, 64.6, DIG. 68

[56] References Cited

U.S. PATENT DOCUMENTS

| | | | |
|---|---|---|---|
| 1,870,411 | 8/1932 | Horscroft | 261/63 X |
| 1,968,553 | 7/1934 | Heitger | 261/39.3 |
| 2,110,211 | 3/1938 | Farrell | 261/39.3 |
| 3,395,899 | 8/1968 | Kopa | 261/57 X |
| 3,836,128 | 9/1974 | Lunsford | 261/63 X |
| 4,158,352 | 6/1979 | Blatter | 261/63 X |
| 4,769,185 | 9/1988 | Nagasaka et al. | 261/35 |
| 4,770,823 | 9/1988 | Sejimo | 261/39.1 |
| 5,200,118 | 4/1993 | Hermle | 261/64.6 |
| 5,215,049 | 6/1993 | Wolf | 261/52 X |
| 5,992,829 | 11/1999 | Andreasson | 261/35 |

*Primary Examiner*—Richard L. Chiesa
*Attorney, Agent, or Firm*—Robert W. Becker & Associates

[57] ABSTRACT

A diaphragm carburetor for a combustion engine having a manual starter has a housing and a control chamber arranged in the housing and filled with fuel. A suction channel is arranged in the housing and has a venturi section. A throttle flap is rotatably supported in the suction channel downstream of the venturi section in the flow direction of combustion air sucked into the suction channel. A main valve path connects a control chamber to the venturi section. An idle valve path connects the control chamber to the suction channel and opens into the suction channel at a location downstream of the throttle flap in the flow direction. A choke flap is rotatably supported in the suction channel and positioned upstream of the venturi section. The choke flap has identical cold start and warm start positions and allows a flow volume of combustion air into the suction channel sustaining engine operation after the engine has been started.

13 Claims, 4 Drawing Sheets

DIAPHRAGM CARBURETOR FOR AN INTERNAL COMBUSTION ENGINE WITH A MANUAL STARTER

BACKGROUND OF THE INVENTION

The present invention relates to a diaphragm carburetor for an internal combustion engine having a manual starter, wherein the diaphragm comprises a fuel-filled control chamber that is connected by a main valve path to a venturi section of the suction channel and is connected by an idle valve path which, in the flow direction of the combustion air, opens via at least one idle valve downstream of a rotatably supported throttle flap into the suction channel. A choke flap is positioned upstream of the venturi section, when viewed in the flow direction of the combustion air, in the suction channel and is rotatable for enriching the fuel/air mixture for cold start as well as warm start conditions of the combustion engine.

Such a diaphragm carburetor is known from German Patent Application 41 20 876 and is provided with a starter for cold start and warm start of the engine. In the suction channel of the diaphragm carburetor a venturi section is provided which in the flow direction of the combustion air has positioned upstream thereof a choke flap and downstream thereof a throttle flap. The starter closes the choke flap completely during cold start conditions with the exception of a bypass opening. For warm start conditions the choke flap is positioned in a partly open position. In both start positions, the operator must ensure that upon startup of the combustion engine the choke flap is immediately opened so that the fuel/air mixture will not become too rich causing the engine to die.

It is therefore an object of the present invention to embody a diaphragm carburetor of the aforementioned kind such that without actions by the operator the combustion engine after startup continues to run with the choke flap being in the closed position.

SUMMARY OF THE INVENTION

The gist of the invention is that for cold start conditions and warm start conditions the choke flap is in one and the same position. The choke flap is embodied such that, despite remaining in the same position, the motor, after startup, continues to run.

Advantageously, this is achieved by a bypass through which, when the choke flap is closed the necessary amount of combustion air can enter the suction channel. This bypass can be formed between the edge of the choke flap and the inner wall of the suction channel or can be provided by at least one opening within the choke flap itself.

In order to reduce the number of starting attempts for cold start in a temperature range of less than −10° C., it is suggested to close at least one opening of the choke flap by a vacuum valve that is closed when in its resting position. This vacuum valve is designed such that it will open upon the sudden vacuum increase resulting once the combustion engine has started and allows a sufficient amount of combustion air to enter into the running combustion engine so that the fuel/air mixture will not become too rich.

Advantageously, the bypass is dimensioned such that for starting the combustion engine the fuel/air mixture has a lambda value of 0.5, whereby in the starting position of the choke flap the combustion engine continues to run at an idle rpm (revolutions per minute) of approximately 3,000–5,000.

BRIEF DESCRIPTION OF THE DRAWINGS

The object and advantages of the present invention will appear more clearly from the following specification in conjunction with accompanying drawings, in which.

DESCRIPTION OF THE PREFERRED EMBODIMENTS

The present invention will now be described in detail with the aid of several specific embodiments utilizing FIGS. 1 through 8.

Figure 1:
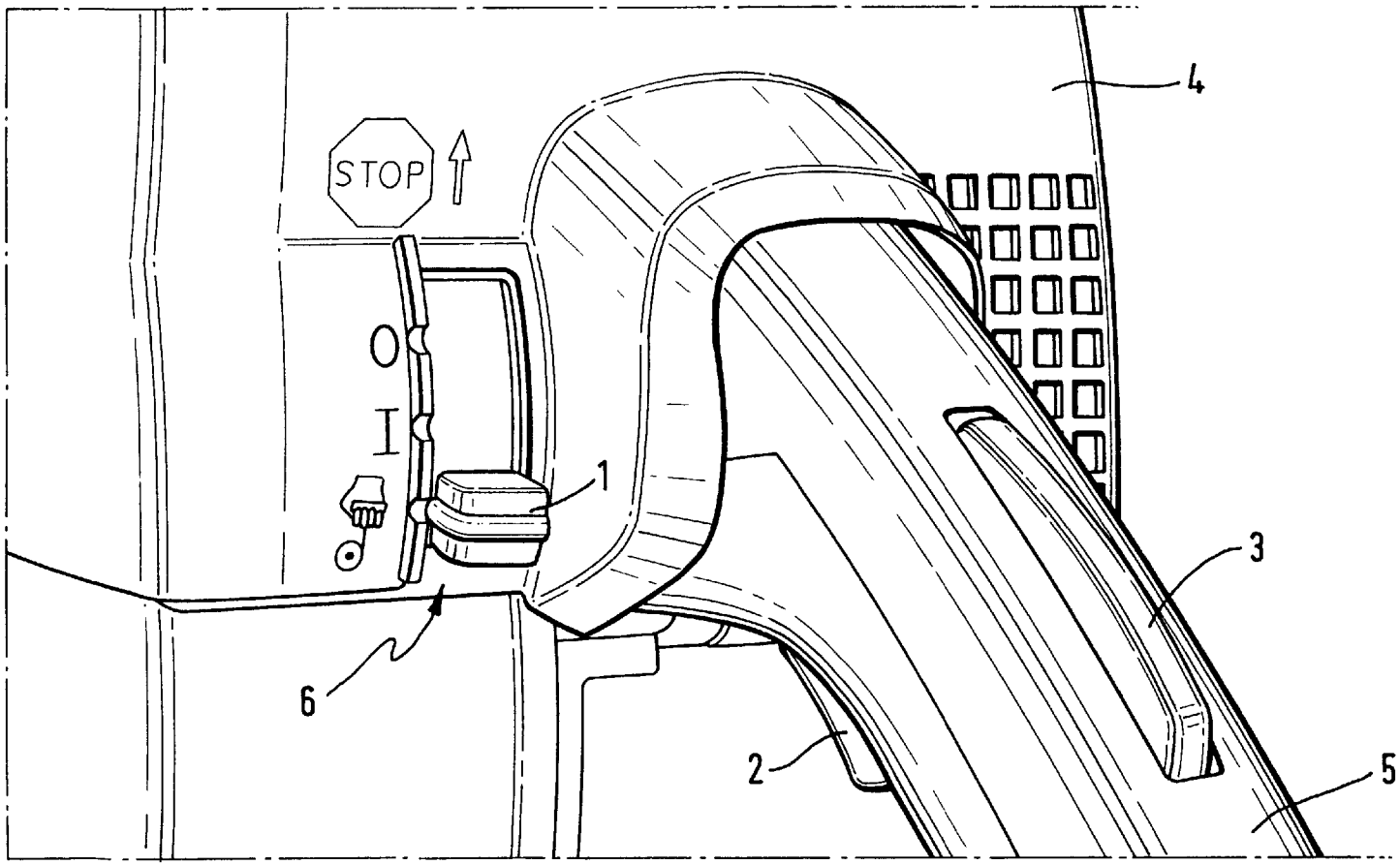
FIG. 1 shows a schematic part-sectional view of the rear housing portion of a motor chainsaw with starter.

FIG. 1 shows a view of the housing 4 of a motor chainsaw with rear grip 5. Within a portion of the rear grip 5 adjacent to the housing 4 a gas lever 2 as well as a gas lever lock 3 are arranged. The internal combustion engine is arranged in the housing 4 and is provided with a diaphragm carburetor 7 that supplies an ignitable fuel/air mixture to the combustion engine. The diaphragm carburetor 7 is represented in detail in FIGS. 2 through 4. The starter device 6 cooperates via a non-represented linkage with the rotatable choke flap 11 and throttle flap 12 arranged in the suction channel 10 of the diaphragm carburetor 7. Within the access range of the thumb of a hand positioned on the grip 5, the actuating button 1 of starter 6 is arranged which is positioned in the housing 4. It serves, on the one hand, for short-circuiting the ignition upon shutting down the combustion engine and, on the other hand, determines in the start position the pivot position of the choke flap 11 and of the throttle flap 12 in the suction channel 10.

The starter 6 has three positions as indicated in FIG. 1. In the position "0" the ignition is short-circuited and the motor is thus shut off. The position "I" represents the normal operating position of the combustion engine. In this operating position, the combustion engine is controlled by the gas lever 2 after the gas lever lock 3 has been released. In the position "start" the choke flap 11 and the throttle flap 12 of the diaphragm carburetor 7 arranged within the internal combustion engine are positioned in a predetermined start position. The combustion engine can be a two-stroke or a four-stroke engine.

Figure 2:
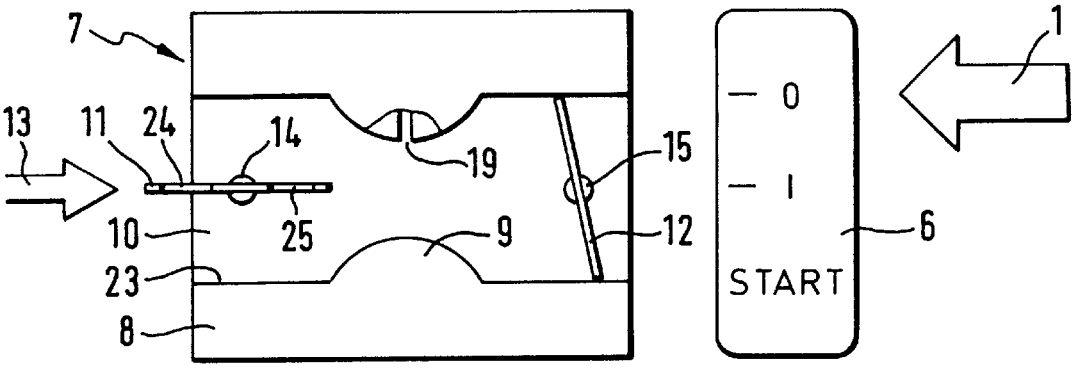
FIG. 2 shows in a schematic sectional view of a diaphragm carburetor in the shut-down position of the internal combustion engine.
Figure 3:
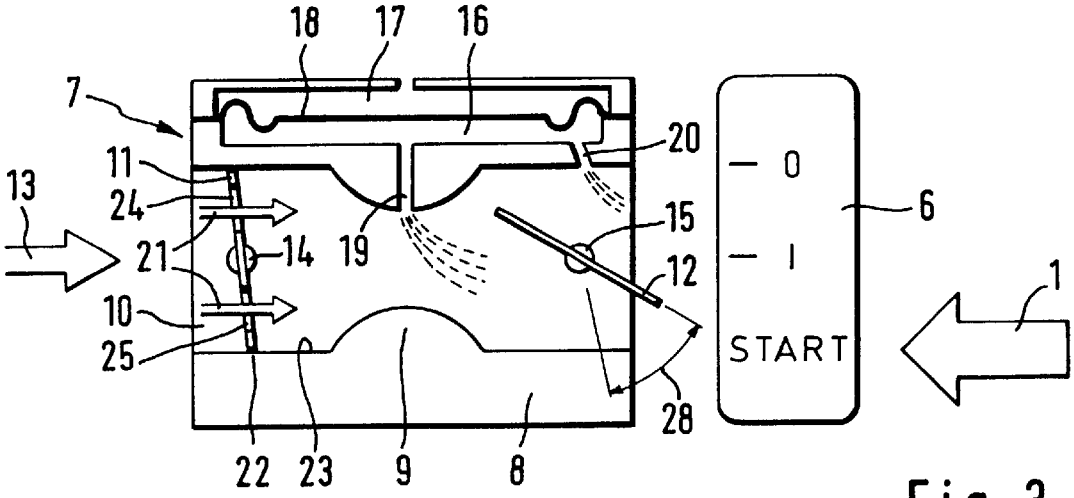
FIG. 3 shows in a schematic sectional view a diaphragm carburetor in the starting position of the combustion engine.
Figure 4:
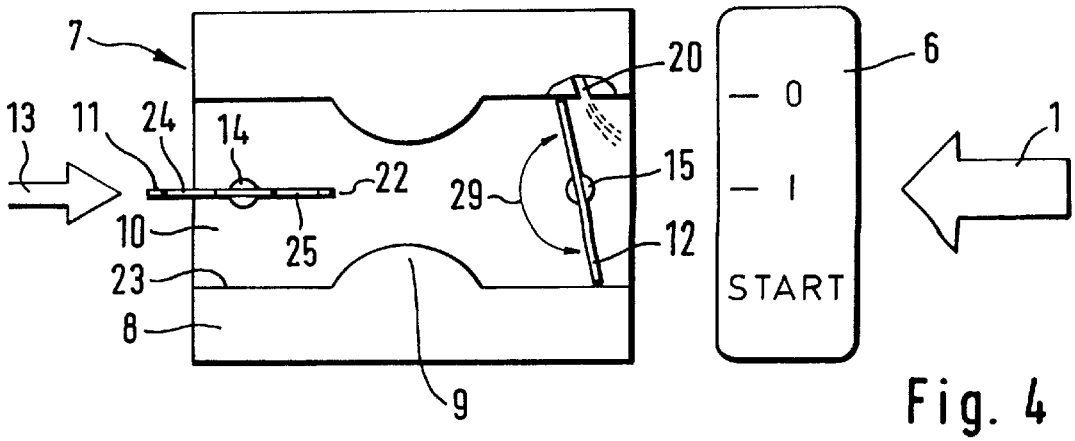
FIG. 4 shows a schematic sectional representation of a diaphragm carburetor in idle position of the combustion engine.
Figure 5:
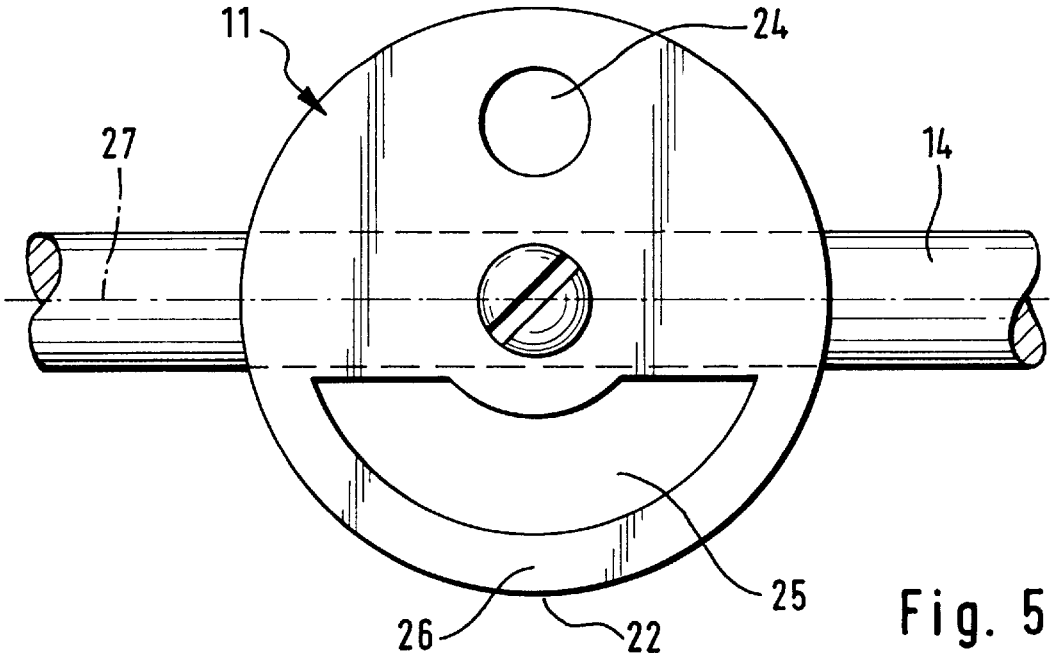
FIG. 5 shows the choke flap in a schematic view.

The different positions of the starter 6 are schematically indicated in FIGS. 2 through 4. In these Figures, the diaphragm carburetor 7 is shown as having a housing 8 with a suction channel arranged therein whereby the suction channel 10 has a venturi section 9. In the flow direction 13 of the incoming combustion air 21 a choke flap 11 is arranged upstream of the venturi section 9. In the flow direction 13 downstream of the venturi section 9 a throttle flap 12 is arranged within the suction channel 10. Both flaps 11 and 12 are rotatably on shafts 14, 15 within the suction channel 10 whereby the throttle flap shaft 15 is connected by a non-represented linkage to the gas lever 2 and can be moved by it in the direction of the arrow 29. The starter 6 is coupled in a manner known per se to the choke flap shaft 14 and the throttle flap shaft 15 such that in the start position according to FIG. 3 the choke flap is in a closed position and the throttle flap 12 in a partly open position.

FIG. 3 shows that in the housing 8 of the diaphragm carburetor 7 a fuel-filled control chamber 16 is formed which is separated from the atmospheric chamber 17 by a control diaphragm 18. The control diaphragm 18 controls in a manner known per se the fuel flow to the control chamber 16.

A main valve path 19 branches from the control chamber 16 into the venturi section 9 of the suction channel 10. In the flow direction 13 of the incoming combustion air 21 an idle valve path opens via idle valve 20 downstream of the throttle flap 12 into the suction channel 10. The idle valve path may also be branched off the main valve path 19. However, preferably, a plurality of idle valves are arranged which open in the area of the throttle flap 12 into the suction channel 10. One of the idle valves 20 is positioned, as shown schematically in FIGS. 3 and 4, downstream of the throttle flap 12 in the flow direction 13 of the combustion air 21.

In the stop position of the starting device 6, i.e., in the position "0", the electrical ignition, not represented in the drawing, is electrically short-circuited. The choke flap 11 is in its open position and the throttle flap 12 in its closed position that determines idle operation of the combustion engine (FIG. 2).

In the starting position of the starter 6, the choke flap 11 is closed. For starting the combustion engine, the throttle flap 12 is held by the starter 6 in a partly open position. As shown in the embodiment of FIG. 3, the edge 22 of the choke flap 11 in the shown closed position is substantially tightly positioned at the inner wall 23 of the suction channel 10. In order to allow combustion air 21 to flow in the flow direction 13 into the suction channel 10, the choke flap 11 has openings 24 and 25 forming a bypass. The opening 24 is arranged at a side of the axis of rotation 27 of the throttle flap shaft 14 while on the other side of the axis 27 a part annular opening 25 is provided. The stay 26 remaining by providing the part-annular embodiment of the opening 25 rests with the outer edge 22 substantially tightly at the inner wall 23 of the suction channel 10.

The openings 24 and 25 are dimensioned such that for starting the combustion engine a sufficient fuel/air mixture is ensured, that however upon startup of the combustion engine a sufficient amount of combustion air 21 can flow in in order to keep the engine running. The adjustment is such that for a closed choke flap 11 after startup of the combustion engine an rpm of approximately 3,000–5,000 is provided, preferably approximately 4,000, whereby the mixture has a lambda value of approximately 0.5. The throttle flap 12 in the start position according to FIG. 3 is opened at an angle of approximately 20°, preferably greater than 20°, as indicated by the angle 28 in FIG. 3.

Figure 6:
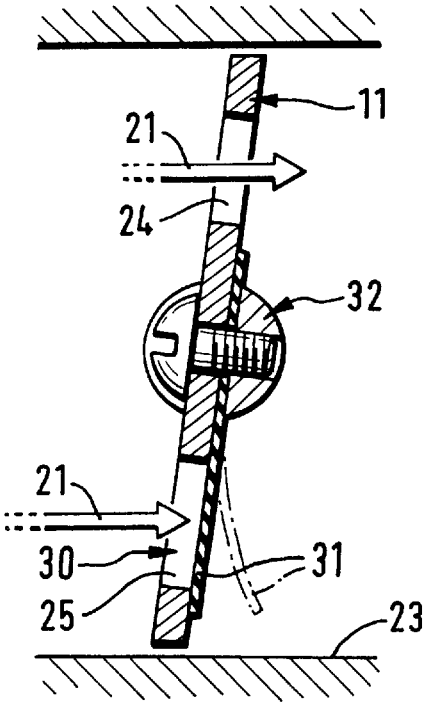
FIG. 6 shows a section of the choke flap according to FIG. 5 with a vacuum valve arranged thereat.

After startup of the combustion engine, the starter 6, according to FIG. 4, is returned into the operating position "I" which after the first actuation of the gas lever 2 is performed automatically by correspondingly arranged springs. In the operating position according to FIG. 4 the choke flap 11 is completely open. The throttle flap 12 is in its idle position and can be pivoted by the gas lever 2 via a linkage known per se acting on the throttle flap shaft 15 in the direction of double arrow 29. In order to ensure safe starting of the combustion engine in cold start conditions below the 0° C. limit, especially in cold start conditions in temperature ranges of less than −10° C., it is suggested to close off at least one opening 25 of the choke flap 11 by a vacuum valve 30 that is closed in its rest position as is shown in FIG. 6. This vacuum valve 30 is expediently embodied as a flexible valve plate 31 of an advantageously elastic material that is spring-loaded into its closed position. This valve plate 31 is fastened to the choke flap 11 downstream in the direction of the incoming combustion air 21. For this purpose, a fastener 32 can be provided with which the choke flap 11 is attached to the choke flap shaft 14.

In the start position according to FIG. 3, the elastic valve plate 31 closes due to the spring force acting thereon the bypass opening 25 so that only the upper bypass opening 24 in the choke flap 11 allows combustion air 21 to flow through. Thus, downstream of the choke flap 11 a great vacuum is produced that results in fuel flow from the main valve path 19 and, via the idle valve path, from the idle valves. The mixture is very rich and ignitable so that the combustion engine will startup after a few rotations of the crank shaft. After startup of the combustion engine, the vacuum will increase suddenly downstream of the choke flap 11, and the sudden vacuum increase results in opening of the valve plate 31, as indicated in a dashed line in FIG. 6. Through the bypass opening 25 additional combustion air 21 can now flow into the suction channel 10 so that the mixture is less rich and is maintained in an ignitable range. The combustion engine remains operative so that a rpm of approximately 3,000–5,000 will result. The mixture has a lambda value of approximately 0.5. Even if the operator after startup of the combustion engine does not return the choke flap 11 into its initial position, respectively, does not return the starter 6 into the operating position "I", the combustion engine will operate reliably at the provided rpm. When the operator actuates the gas lever 2, the starter 6 will automatically return into the operating position "I" in which the choke flap 11 is completely open and the enrichment of the fuel/air mixture is canceled.

Figure 7:
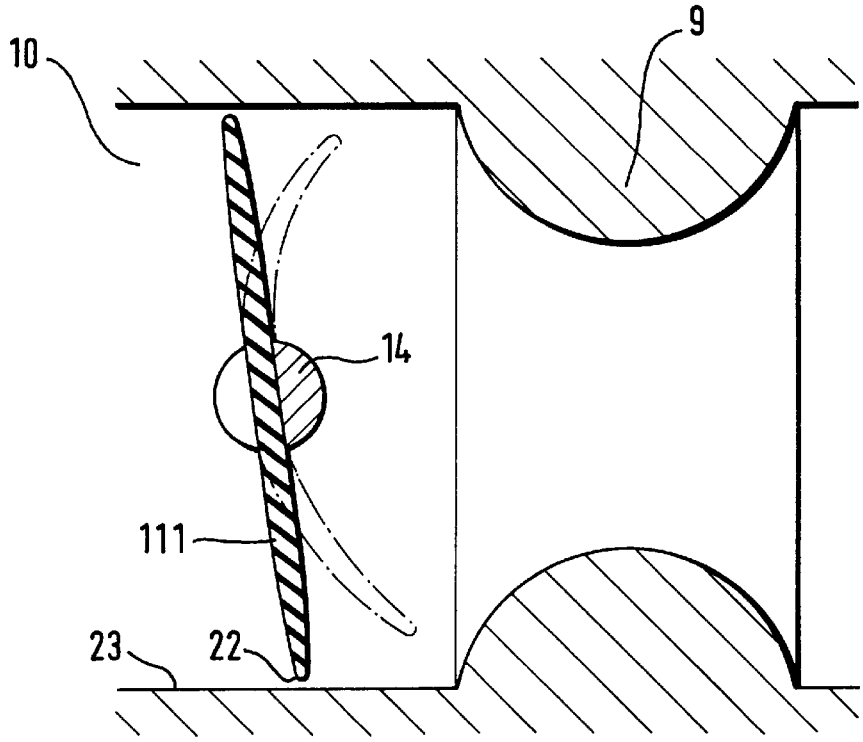
FIG. 7 shows in a schematic representation a different embodiment of a choke flap.

In another embodiment of the choke flap according to FIG. 7, the bypass for introducing the required combustion air is provided between the edge 22 of the choke flap 111 and the inner wall 23 of the suction channel 10. The thus limited bypass is dimensioned such that the choke flap 111 during warm start and cold start conditions has the same shown start position, and the resulting mixture, after startup of the combustion engine, has the lambda value of approximately 0.5. In order to ensure for very low temperatures below −10° C. a reliable startup, the bypass gap between the edge 22 of the choke flap 111 and the inner wall 23 of the suction channel 10 can be more narrow in order to provide for a greater enrichment of the fuel/air mixture. In order to prevent during startup of the combustion engine the formation of a mixture that is too rich causing the combustion engine to die, the choke flap 111 is made of an elastic material. Upon startup of the combustion engine, the suddenly increasing vacuum downstream of the elastic choke flap 11 results in a deformation as shown by the dashed representation in FIG. 7 so that the bypass gap between the edge 22 and the inner wall 23 will widen and an increased amount of combustion air can flow in. Accordingly, a mixture formation that is too rich will be prevented automatically by the presence of the increasing vacuum. The lambda value is approximately 0.5. The combustion engine, despite the closed choke flap, continues to run with a rpm of approximately 3,000–5,000.

Figure 8:
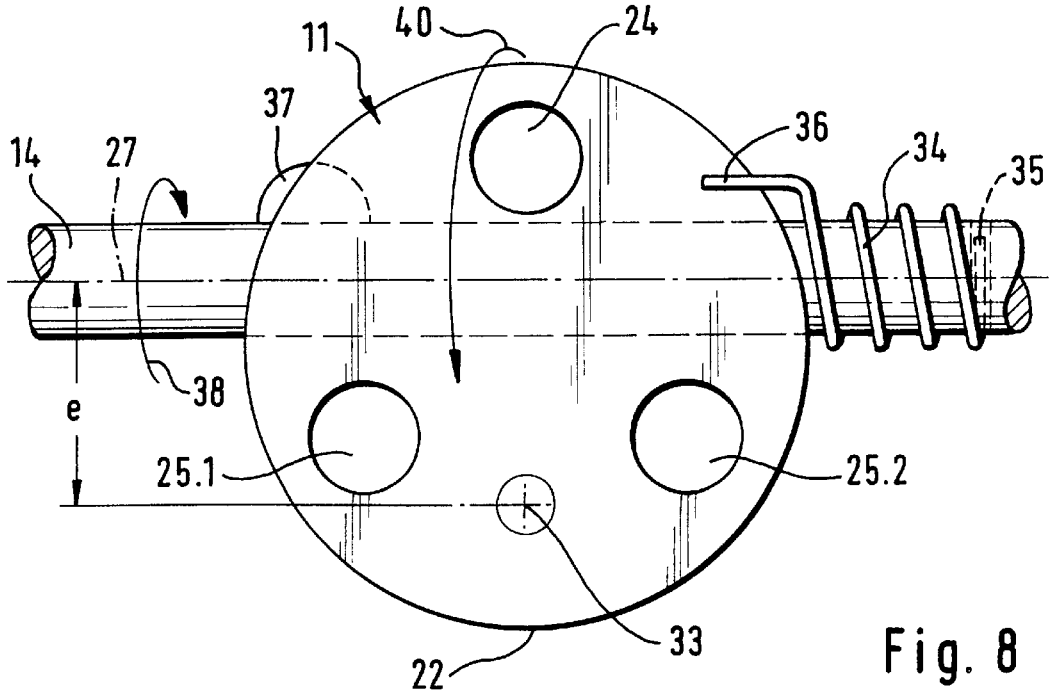
FIG. 8 shows in a schematic representation a further embodiment of a choke flap with eccentric pivot shaft.

In the embodiment according to FIG. 8, the choke flap 11 has bypass openings 24, 25.1, and 25.2. The choke flap 11 is secured eccentrically on the choke flap shaft 14 whereby the vacuum forces acting on the choke flap act thereon at an imaginary point of action 33 spaced at a distance e to the axis of rotation 27. The choke flap 11 is expediently rotatably supported on the choke flap shaft 14. A torsion spring 34 is provided which is secured with its end 35 at the shaft 14 and whose other end 36 acts on the choke flap 11 such that it forces the choke flap 11 against an abutment 37 in the direction of arrow 38. The abutment 37 is provided at the choke flap shaft 14. A rotation of the choke flap shaft 14 thus results always in a rotation of the choke flap 11 which, under the action of the torsion spring 34 or any other suitably designed spring, is thus essentially fixedly connected to the choke flap shaft 14.

For starting the combustion engine, the choke flap 11 is moved by the shaft 14 into a position according to FIG. 3. Combustion air 21 can flow only through the openings 24, 25.1, and 25.2. When the combustion engine starts up, the sudden vacuum increase downstream of the choke flap 11 results in a force increase at the point of action 33. The torque acting at the point 33 as a result of the vacuum caused by the running combustion engine will pivot the choke flap 11 against the force of the spring 34 in the direction of arrow 40 so that due to the increased vacuum the choke flap 11 is rotated into a partly open position against the force of the spring 34. In this partly open position the edge 22 is positioned about a portion of its circumference at a spacing to the inner wall 23 of the suction channel 10 so that via the thus formed gap additional combustion air can flow in. Thus, the formation of a fuel/air mixture that is too rich is prevented. The fuel/air mixture has a lambda value of approximately 0.5. The combustion engine keeps continues to run despite the fact that the starter 6 remains in the start position with an rpm of approximately 3,000–5,000.

The functionality of the inventive diaphragm carburetor results from the fact that the combustion engine is operated with an average fuel/air mixture during the starting process within a permissible range of the fuel/air mixture, i.e., with respect to optimized mixtures for specific starting conditions, the combustion engine is operated with a mixture that is too rich during warm start conditions and with a mixture that is not rich enough during cold start conditions. The invention ensures a sufficient supply of combustion air, while accepting a reduced lambda fluctuation range. However, the conditions are such that the combustion engine keeps running.

The specification incorporates by reference the disclosure of German Priority document 197 37 763.7 of Aug. 29, 1997.

The present invention is, of course, in no way restricted to the specific disclosure of the specification and drawings, but also encompasses any modifications within the scope of the appended claims.

What is claimed is:

1. A diaphragm carburetor for a combustion engine having a manual starter, said diaphragm carburetor comprising:

a housing (8);

a control chamber (16) arranged in said housing (8) and filled with fuel;

a suction channel (10) arranged in said housing (8);

said suction channel (10) having a venturi section (9);

a throttle flap (12) rotatably supported in said suction channel (10) downstream of said venturi section (9) in a flow direction (13) of combustion air being sucked into said suction channel (10);

a main valve path (19) connecting said control chamber (16) to said venturi section (9);

an idle valve path (20) connecting said control chamber (16) to said suction (10) and opening into said suction channel (10) at a location downstream of said throttle flap (12) in said flow direction (13);

a choke flap (11, 111) rotatably supported in said suction channel (10) and positioned upstream of said venturi section (9);

said choke flap (11, 111) having identical cold start and warm start positions and allowing a flow volume of combustion air (21) into said suction channel (10) sustaining running of the engine after startup;

a bypass (24 25; 25.1, 25.2) for combustion air when said choke flap (11, 111) is in a closed position, said bypass (24 25; 25.1, 25.2) dependent on and controllable by a vacuum pressure downstream of said choke flap (11, 111).

2. A diaphragm carburetor according to claim 1, wherein said bypass (24, 25) is located between an edge of said choke flap (111) and an inner wall (23) of said suction channel (10).

3. A diaphragm carburetor according to claim 2, wherein said bypass (24, 25; 25.1, 25.2) is at least one opening in said choke flap (11).

4. A diaphragm carburetor according to claim 4, further comprising a vacuum valve (3) closing off in a rest position said at least one opening (25).

5. A diaphragm carburetor according to claim 3, further comprising a flexible valve plate (31) biased by a spring into a position closing off said at least one opening (25).

6. A diaphragm carburetor according to claim 5, wherein said valve plate (31) consists of an elastic material.

7. A diaphragm carburetor according to claim 3, wherein said edge (22) of said choke flap (11) in a closed position of said choke flap (11) rests tightly at said inner wall (23).

8. A diaphragm carburetor according to claim 1, wherein said choke flap (111) consists of a flexible material.

9. A diaphragm carburetor according to claim 1, wherein said choke flap (11) has an eccentric shaft (27) about which said choke flap (11) pivots, wherein said choke flap (11) is forced by a spring into a start position and wherein a vacuum force acting on said choke flap (11) counteracts a force of said spring.

10. A diaphragm carburetor according to claim 1, wherein said bypass (24, 25; 25.1, 25.2) is dimensioned such that during the start phase the fuel/air ratio has a Lambda value of 0.5.

11. A diaphragm carburetor according to claim 1, wherein said throttle flap (12) in a start position has an opening angle of at least 20°.

12. A diaphragm carburetor according to claim 11, wherein an idle rpm (revolutions per minute) in a start position of said choke flap (11) is 3,000 to 5,000.

13. A diaphragm carburetor according to claim 12, wherein said idle rpm is 4,000.

* * * * *